US008813280B1

(12) United States Patent
Arora

(10) Patent No.: US 8,813,280 B1
(45) Date of Patent: Aug. 26, 2014

(54) ARTICLE OF BEDDING

(71) Applicant: Indo Count Industries Ltd., Maharashtra (IN)

(72) Inventor: Deepak Kumar Arora, Maharashtra (IN)

(73) Assignee: Indo Count Industries Ltd, Thane West (IN)

( * ) Notice: Subject to any disclaimer, the term of this patent is extended or adjusted under 35 U.S.C. 154(b) by 0 days.

(21) Appl. No.: 14/096,331

(22) Filed: Dec. 4, 2013

Related U.S. Application Data

(60) Provisional application No. 61/820,366, filed on May 7, 2013.

(51) Int. Cl.

| | |
|---|---|
| ***A47G 9/00*** | (2006.01) |
| ***A47G 9/02*** | (2006.01) |
| ***D06H 7/00*** | (2006.01) |
| ***D06H 5/00*** | (2006.01) |
| ***D05B 1/12*** | (2006.01) |

(52) U.S. Cl.
CPC ..... *A47G 9/0246* (2013.01); *D06H 7/00* (2013.01); *D06H 5/00* (2013.01); *D05B 1/12* (2013.01)
USPC ..... 5/497; 5/499; 5/482

(58) Field of Classification Search
USPC ..... 5/482, 495–497, 499; 112/402, 413, 112/418
See application file for complete search history.

(56) References Cited

U.S. PATENT DOCUMENTS

| | | | | | |
|---|---|---|---|---|---|
| 2,528,313 | A * | 10/1950 | Kessler | 5/497 |
| 2,942,280 | A * | 6/1960 | May, Jr. | 5/497 |
| 3,013,283 | A * | 12/1961 | Steffinich | 5/497 |
| 3,438,068 | A * | 4/1969 | Anderson et al. | 5/497 |
| 4,703,530 | A * | 11/1987 | Gusman | 5/497 |
| 5,287,574 | A | 2/1994 | Kardell et al. | |
| 7,398,570 | B2 | 7/2008 | Seago | |
| 8,171,581 | B2 | 5/2012 | Agarwall | |
| 8,671,476 | B2 * | 3/2014 | Stewart et al. | 5/482 |
| 2008/0072378 | A1 * | 3/2008 | Head | 5/497 |

* cited by examiner

*Primary Examiner* — Michael Trettel
(74) *Attorney, Agent, or Firm* — Gottlieb, Rackman & Reisman, PC

(57) ABSTRACT

An article of bedding for disposition over the top, side and end surfaces of a mattress comprises a substantially inelastic web of textile material which includes a top panel, side and end panels, and corner seams. The article further comprises a stretchable corner member overlying each corner seam, an additional seam aligned axially with each corner seam, and a stretchable border member secured to the peripheral edges of the side panels. This construction allows the article to accommodate the contours of mattresses of varying thicknesses within each given peripheral mattress size classification. Methods of making such articles are also disclosed.

49 Claims, 7 Drawing Sheets

ARTICLE OF BEDDING

REFERENCE TO RELATED APPLICATIONS

This application claims the benefit under 35 U.S.C. §119(e) of prior U.S. Provisional Patent Application Ser. No. 61/820,366 filed May 7, 2013.

TECHNICAL FIELD

The present invention relates generally to articles used for bedding, and in particular, to bed sheets, blankets, quilts, duvets or duvet covers. More specifically, this invention relates to an improved bedding product that is placed on a mattress and is configured to fit the contours of the mattress tightly. Although the invention will be described in relation to a fitted bed sheet, it is to be understood that it could be used for other bedding articles as well

BACKGROUND OF THE INVENTION

Fitted sheets, which are also referred to as "bottom" sheets, are conventionally formed of fabric and are used to cover and protect a mattress. A fitted sheet typically comprises a top panel, two side panels and two end panels, and in general, the top panel is disposed over the top surface of the mattress, while each of the four side and end panels extends from the top panel and covers a sidewall or endwall, and at least a portion of the bottom surface, of the mattress. Further, each side panel is usually joined to each adjacent end panel at their respective edges by seams, in a manner to form corners adapted to conform to the shape of the mattress. A fitted sheet may also include some arrangement for securing the fitted sheet to the mattress and/or for keeping the fitted sheet in place on the mattress.

Nevertheless, fitted sheets often become displaced during use, which causes a disheveled look, and which may also cause discomfort to the user. Moreover, although nowadays mattresses are available commercially in several popular sizes, having width and length dimensions that are standardized within the bedding industry (e.g., "king," "queen," "full," "twin," etc.), in fact the dimensions of mattresses do vary from manufacturer to manufacturer, and even among the various mattress lines or models of the same manufacturer, particularly with respect to the thickness of the mattress. In other words, there is no "standard" mattress thickness dimension; rather, the thickness of particular mattresses may vary, depending on a number of factors such as the type or manufacturer of the bed, and the preferences of individual users. Therefore, fitted sheets designed for use on a mattress of a particular size, such as a "queen" size mattress, may not fit snugly on all mattresses of that size. Moreover, over time, an individual mattress may tend to change its size and shape, due to a variety of factors such as age and/or excessive use and/or environmental factors.

Accordingly, there is a need for a fitted sheet capable of remaining in place during use, and which, at the same time, can accommodate and fit snugly on mattresses of varying thicknesses, and can also adapt to any changes in mattress size and shape, while continuing to appear smooth and neat, at least along the top surface and sidewalls of the mattress. Although efforts have been made in the prior art to provide fitted sheets that can overcome these problems, such as those described in U.S. Pat. Nos. 5,287,574, 7,398,570 and 8,171,581, those efforts have not been completely satisfactory.

Most of these prior art solutions involve blending stretchable and non-stretchable portions into the fabric that forms the side panels of the sheet, such that the stretchable fabric portions are located at or near the corners. However, this solution may lead to undesirable consequences, such as differential shrinkage of the sheet after laundering, as well as a "mottled" appearance due to slight differences in the coloration of portions of the sheet, either initially or after laundering. These undesirable consequences are a direct result of blending stretchable and non-stretchable yarns into portions of the fabric, as these portions are assembled of yarn fibers having different characteristics. Since such blending is common to all of these prior art solutions, it is a fundamental flaw of the prior art.

It is therefore the principal object of the present invention to provide improved fitted bed sheets which are capable of remaining in place during use, which can fit the contours mattresses of varying thicknesses, and which, at the same time, do not exhibit the undesirable effects caused by the incorporation into the side panels of the sheet of both stretchable and non-stretchable portions of fabric.

SUMMARY OF THE INVENTION

This and other objects of the present invention are achieved by providing an improved fitted sheet including a top panel and side and end panels that are continuous and made from the same fabric, using any standard fabric construction process such as weaving or knitting. A special seam is provided at the corners to insure that the sheet fits snugly over the mattress and does not pop up during usage. In addition, flexible and stretchable strips or tapes, which stretch when pulled, are used at those corner seams and also along the free peripheral edges of the side panels.

Thus, one aspect of the present invention generally concerns improved articles for use as bedding materials, while another aspect of the present invention concerns methods for fabricating such articles.

BRIEF DESCRIPTION OF THE DRAWINGS

These and other aspects, features, objects and advantages of the present invention will become more apparent to those skilled in the art from the following detailed description of the presently most preferred embodiments thereof (which are given for the purposes of disclosure), when read in conjunction with the accompanying drawings (which form a part of the specification, but which are not to be considered as limiting its scope), wherein.

DETAILED DESCRIPTION OF THE PREFERRED EMBODIMENT

The preferred embodiment of the present invention will now be further described. As stated above, although the invention will be illustratively described hereinafter with reference to the formation of a fitted bed sheet, it should be understood that the invention is not limited to the specific case described, but extends also to the formation of other bedding items, such as blankets, quilts, bedspreads, duvets and duvet covers.

Figure 2:
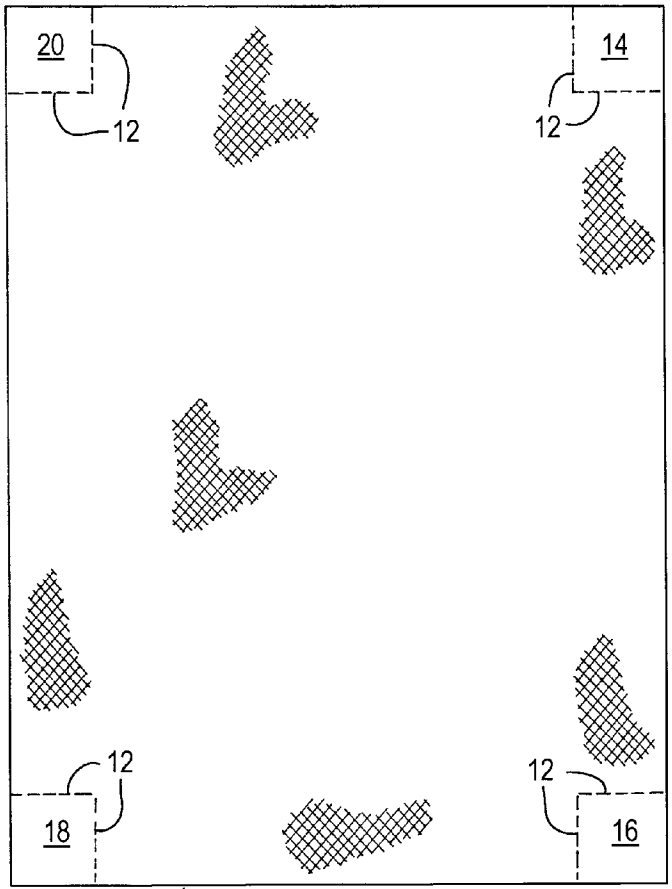
FIG. 2 is a view substantially similar to FIG. 1, illustrating in phantom lines the portions of the fabric web which are to be cut away and removed, so as to form side and end panels.
Figure 1:
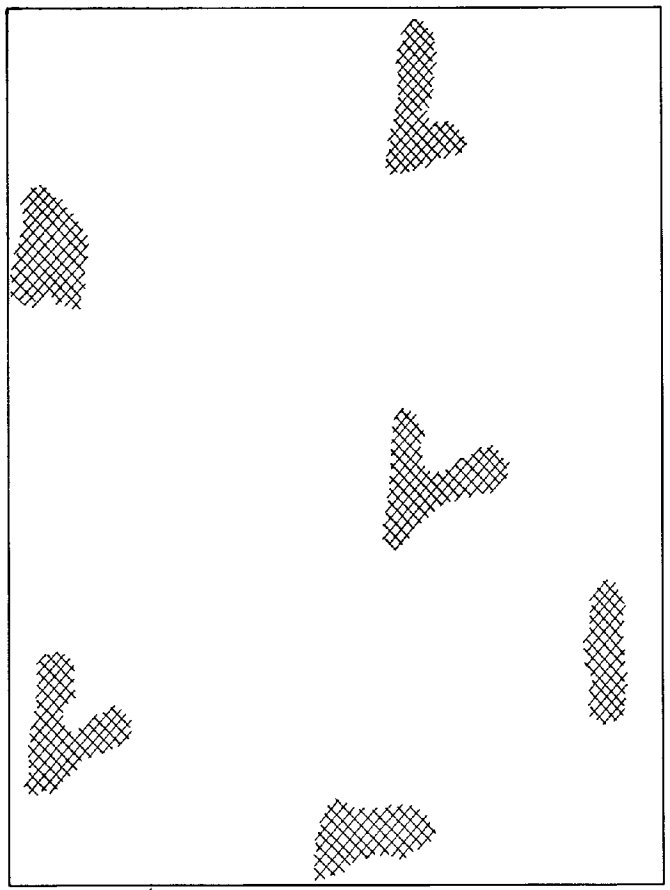
FIG. 1 is a top plan view of a substantially flat rectangular web of fabric from which the fitted sheet of the invention may be formed.
Figure 3:
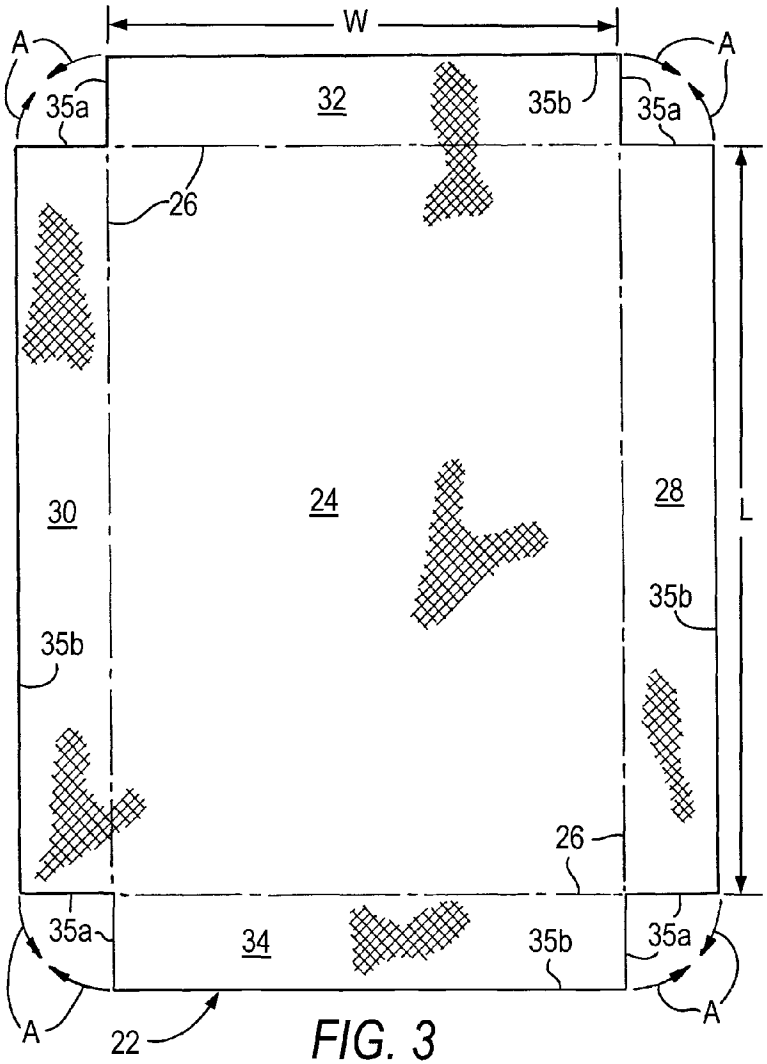
FIG. 3 is a view substantially similar to FIGS. 1 and 2, illustrating diagrammatically how the edge of each respective side panel is drawn towards the edge of an adjacent end panel, prior to stitching.
Figure 8:
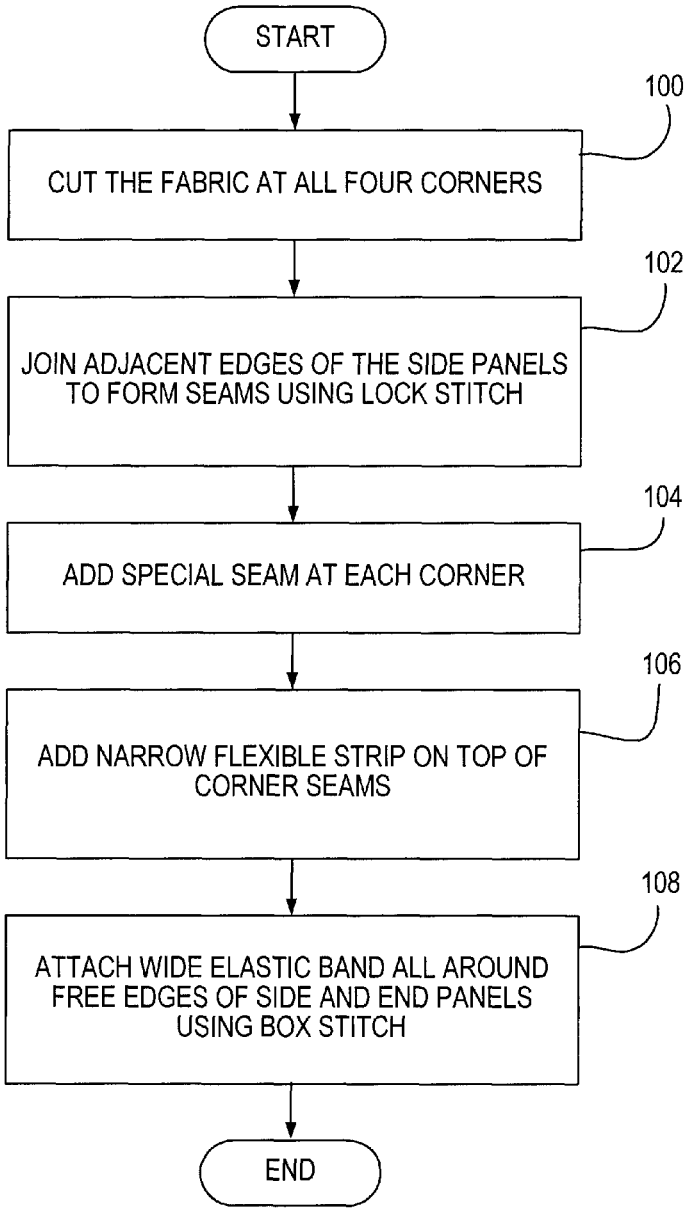
FIG. 8 is a flow diagram depicting the process by which the fitted bed sheet of FIG. 7 is formed, in accordance with the invention, from the rectangular web of fabric of FIG. 1.

Referring first to FIGS. 1-3 and to the flow diagram of FIG. 8, the process of forming the fitted bed sheet of the present invention begins with a flat web of material 10, usually, although not necessarily, rectangular in shape, and preferably formed from a non-stretchable textile fabric that is woven or knitted from cotton, silk, wool, rayon, polyester, viscose and/or other types of threads, yarns or fibers, and combinations thereof, as is conventional in the bedding industry. To form the fitted bed sheet, initially the four corners of web 10 are cut, substantially along the lines 12, as shown in FIG. 2 (step 100 in FIG. 8), forming generally square corner portions 14, 16, 18, 20 that are removed. The resulting modified web 22 is still flat, and as shown in FIG. 3, it includes a top panel 24 having a peripheral edge 26, two opposed side panels 28, 30, as well as two opposed end panels 32, 34. Each of side panels 28, 30 and end panels 32, 34 has two respective side edges 35*a*, as well as a distal edge 35*b*.

Generally, the dimensions of top panel 24 are selected so as to be sufficient to be disposed over, and to cover, the top surface of a mattress (not shown), and the dimensions of side panels 28, 30 and end panels 32, 34 are selected to be sufficient to cover the sidewalls and endwalls, respectively, of the mattress, but they also extend a sufficient distance from the peripheral edge 26 of top panel 24 so as to cover at least a portion of the bottom surface of the mattress as well. In general, no matter what absolute dimensions are chosen for the side and end panels (such dimensions will depend upon the design, configuration, thickness and contours of the mattress on which the fitted bed sheet of the invention is to be used), opposed side panels 28, 30 will have a dimension L that will correspond substantially to the length dimension of the mattress, while opposed end panels 32, 34 will have a dimension W that will correspond substantially to the width dimension of the mattress; thus, opposed side panels 28, 30 will be substantially congruent, and similarly, opposed end panels 32, 34 will also be substantially congruent.

Figure 4:
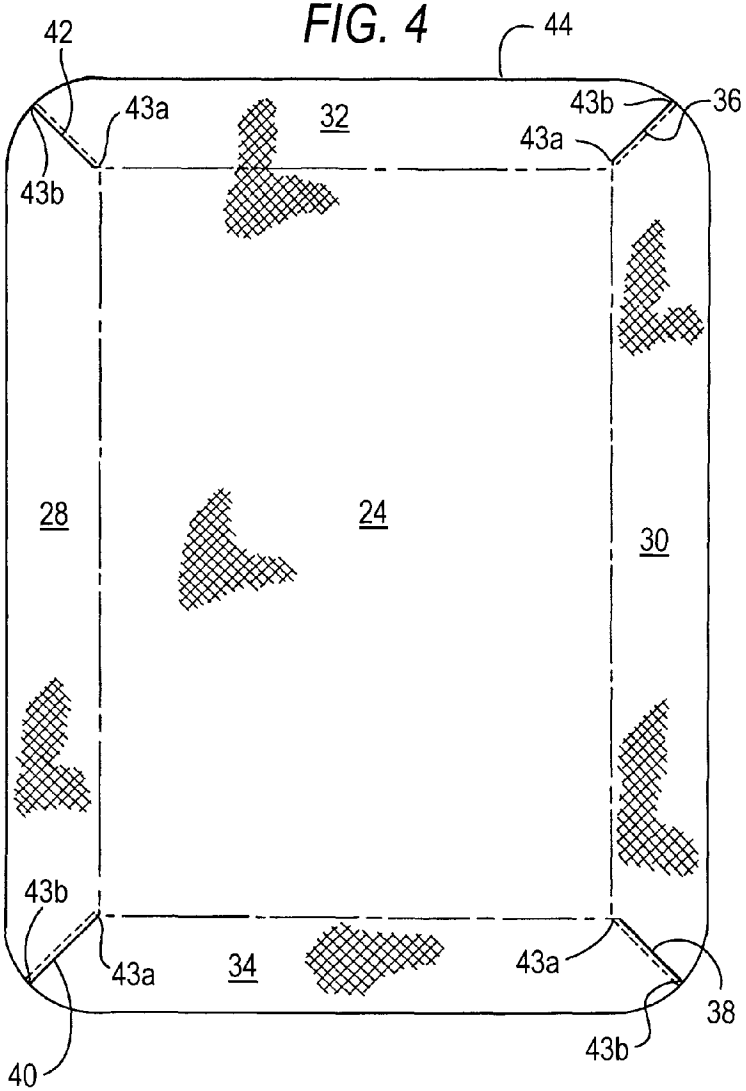
FIG. 4 is a bottom plan view of the fabric web of FIG. 3, after the side and end panels have been joined to form corner seams, thus forming a bed sheet.

Referring now to FIG. 4 in addition to the aforementioned FIGS. 1-3 and 8, the adjacent side edges 35*a* of side and end panels 28, 30, 32, 34 are then brought together as indicated by the arrows A in FIG. 3, and are joined, two by two (step 102 in FIG. 8), to form corner seams 36, 38, 40, 42, respectively, thus resulting in a bed sheet 44. Preferably, a five thread lock stitch is used to join these edges, as illustrated schematically in FIG. 4. This lock stitch uses multiple threads that are interlocked with each other to provide strength for the seams, and this stitch allows bed sheet 44 to accommodate the shape of a mattress at the corners, and maintains the sheet on the mattress. FIG. 4 comprises a reverse view of bed sheet 44 (as compared with FIG. 3), so as to illustrate the positions and orientations of the stitches forming the corners seams. Each of corner seams 36, 38, 40, 42 has a proximal end 43*a* and a distal end 43*b*. As will be apparent, the distal edges 35*b* of the side and end panels 28, 30, 32, 34 together form the peripheral free edge of bed sheet 44.

Figure 5:
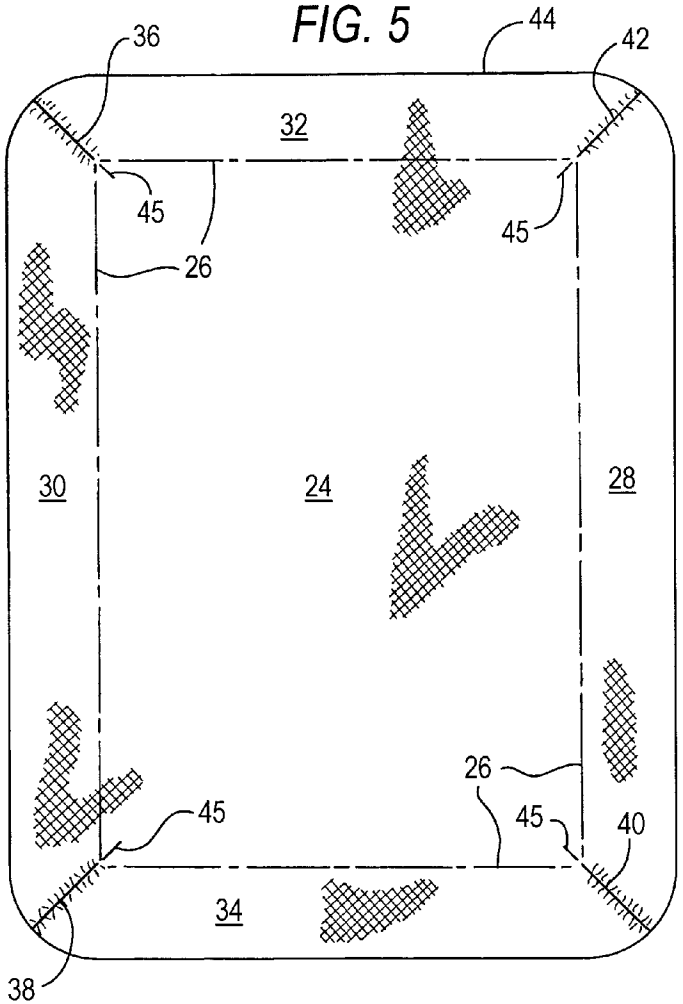
FIG. 5 is a top plan view of the bed sheet of FIG. 4.
Figure 6:
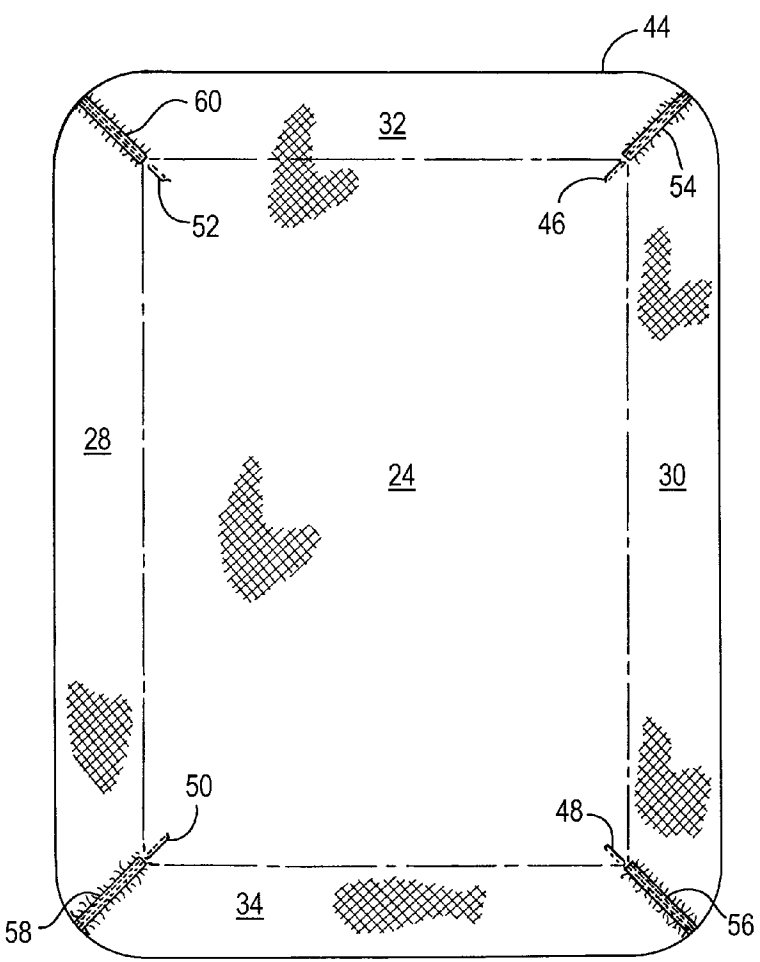
FIG. 6 is a bottom plan view of the bed sheet of FIG. 5, after a flexible and stretchable strip has been added at each corner seam, and after an additional special seam has been formed adjacent each corner.

Referring next to FIGS. 5 and 6 in addition to the aforementioned FIGS. 1-4 and 8, an additional special seam is made (step 104 in FIG. 8) in the fabric of top panel 24 of bed sheet 44 in the general vicinity of each of the corners, along lines 45, each of which, as shown best in FIG. 5 (a view of bed sheet 44 from above), is formed along a line which is an extension of one of the corner seams. Each of these additional seams 46, 48, 50, 52 is preferably about 1.5 inches in length, and each one extends diagonally, from peripheral edge 26 of top panel 24 towards the center of top panel 24, along the same longitudinal axis as the adjacent one of corner seams 36, 38, 40, 42 (FIG. 7A shows the position of these additional seams when the fitted bed sheet of the invention is installed on a mattress). The purpose of these additional seams 46, 48, 50, 52 is to gather some of the fabric material of the bed sheet adjacent to the corners, and they help to insure that at each corner, the top panel 24 and each respective intersecting pair of side and end panels 28, 30, 32, 34, do not form a narrow pocket, but instead fit over the mattress corner snugly and assume the shape of the mattress. These additional seams 46, 48, 50, 52 can be formed using conventional sewing techniques, such as Daug stitching or using lock stitching placed at all four corners.

As previously mentioned, even though mattresses have nominal standard (length×width) sizes, their actual dimensions may vary somewhat. This is particularly true of their thicknesses, which is also referred to herein as their heights. For example, some mattresses may have a height of 7 inches, while others may be as high as 18 inches. It would be inconvenient to manufacture a separate fitted sheet for mattresses of every possible height in each of the standard (length×width) mattress sizes. Therefore, in order to accommodate different heights, the fitted bed sheet of the present invention is provided with flexible and stretchable corner members 54, 56, 58, 60 (step 106 in FIG. 8), one at each corner.

Corner members 54, 56, 58, 60 may be fabricated of any conventional tightly woven elastic material, having a stretch ratio ranging from about 1:2.75 to about 1:3, and may be provided on either surface of the sheet, but preferably they are provided on the surface which will become the inner surface of the sheet, that is, the surface which will be adjacent to the mattress when the sheet is in use. Each corner member is positioned overlying one of the corner seams 36, 38, 40, 42, respectively, as illustrated in FIG. 6, and is secured, preferably via conventional lock stitching; the corner members 54, 56, 58, 60, when the fitted bed sheet of the invention is installed on a horizontally-positioned mattress (FIG. 7A), are generally oriented vertically.

Each corner member 54, 56, 58, 60 is preferably provided in the form of a narrow strip or tape, about 8-12 mm wide, and its length is preferably smaller than the dimension chosen for the length of the side edge 35*a* of each of the side and end panels 28, 30, 32, 34; most preferably, the length of each corner member, before it is secured to bed sheet 44, is chosen to be less than one-half of the length of the side edge 35*a* of the side and end panels 28, 30, 32, 34. It is to be understood that, while the length of the corner members, as specified in the preceding sentence, is measured while each corner member is in a relaxed or "unstretched" condition, each corner member is secured to the sheet in "stretched" condition, that is, prior to securing each corner member to a respective corner seam, each corner member is stretched out, so that it essentially covers the respective corner seam from end to end. The elastic material from which corner members 54, 56, 58 and 60 may be formed is commercially available from a wide variety of sources, such as M/s. Shree Shyam Industries of Bhiwandi, Maharashtra, India and Mahendra Trading Company of Mumbai, Maharashtra, India.

Figure 7:
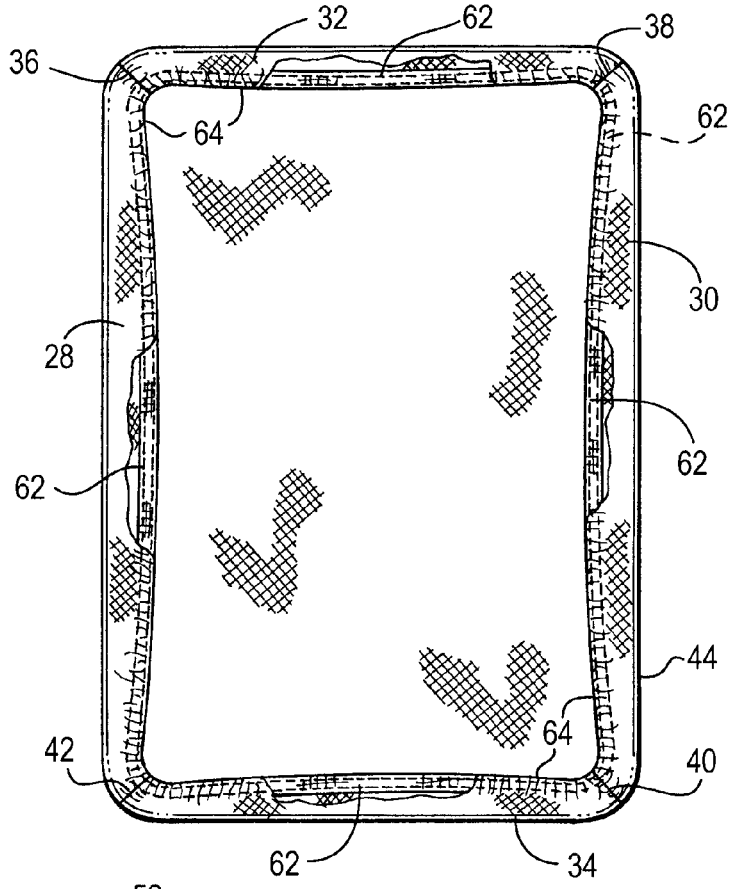
FIGS. 7 and 7A are a bottom plan view, partially broken away, and a side perspective view, respectively, of the bed sheet of FIG. 6, after a flexible and stretchable strip has been stitched to the free peripheral edges of the side and end panels, thus forming the fitted bed sheet of the invention shown covering the top surface, the sidewalls and endwalls, and at least a portion of the bottom surface of a mattress.
Figure 7A:
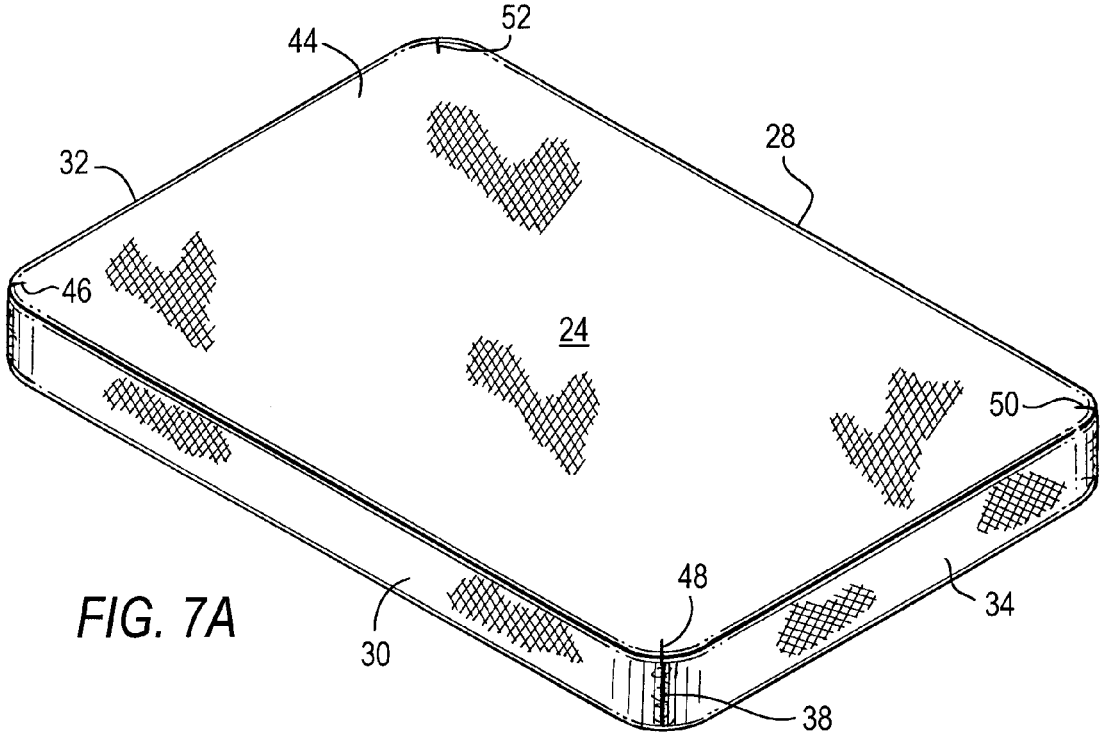

Finally, and referring now to FIG. 7 in addition to the aforementioned FIGS. 1-6 and 8, a border member 62 is secured, preferably via twin needle lock stitching, to the outer edge or perimeter 64 of fitted bed sheet 44 (that is, to the free peripheral edges of the side and end panels 28, 30, 32, 34), as illustrated in FIG. 7 (step 108 in FIG. 8). Border member 62 is preferably provided in the form of a flexible and stretchable strip or tape comprised of a tightly woven elastic material, having a stretch ratio in the range of from about 1:175 to about 1:2, and is preferably about 1 inch (25 mm) wide. Preferably, the overall length of the border member 62 is shorter than the overall length of the perimeter 64 of sheet 44 (the length of perimeter 64 being the combined total of twice the value of dimension W and twice the value of dimension L, as illustrated in FIG. 2) most preferably, the length of border member 62 is chosen to be approximately one-half of the length of perimeter 64.

It is to be understood that, while the length of the border member 62, as specified in the preceding sentence, is measured while it is in the relaxed or "unstretched" condition, the border member is secured to the sheet in "stretched" condition, that is, prior to securing the border member 62 to the perimeter 64 of sheet 44, the border member 62 is stretched out, so that it essentially extends around the entire peripheral free edge of the sheet. Thus, due to the combined effect of flexible and stretchable corner members 54, 56, 58, 60 and flexible and stretchable border member 62, the final fitted bed sheet 44 is formed with a peripheral free edge having an irregular shape (see FIG. 7). The elastic material from which border member 62 may be formed is commercially available from a wide variety of sources, such as M/s. Shree Shyam Industries of Bhiwandi, Maharashtra, India and Mahendra Trading Company of Mumbai, Maharashtra, India.

Figure 9:
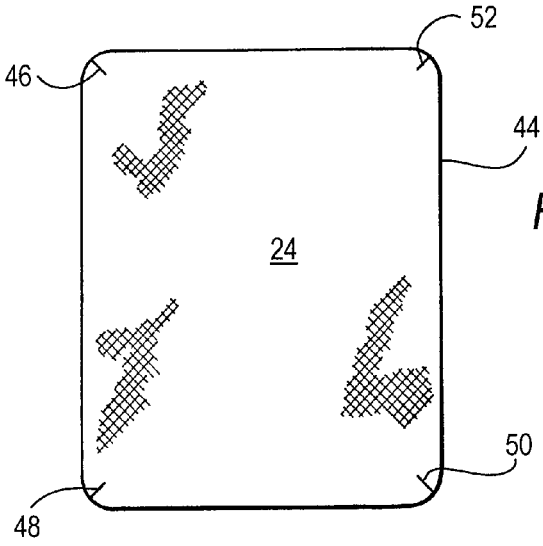
FIG. 9 is top plan view showing the fitted bed sheet of the invention covering the top surface of a mattress.
Figure 10:
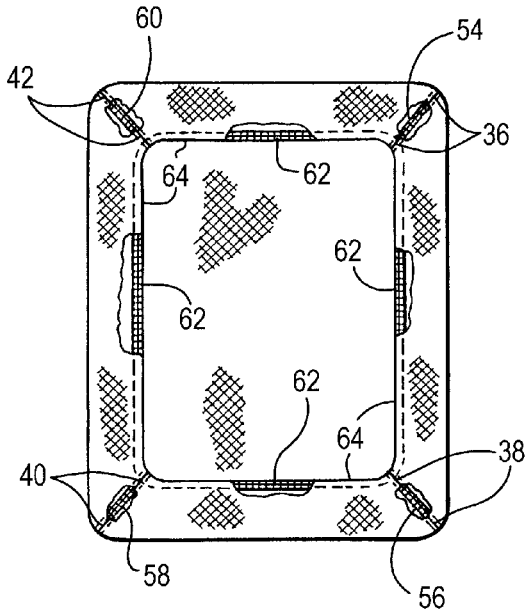
FIG. 10 is a diagrammatic bottom plan view, partially broken away, and substantially similar to FIG. 7, illustrating the fitted bed sheet of the invention covering a portion of the bottom surface of a mattress.

The resulting fitted bed sheet 44 has several advantages over the prior art. Referring now to FIGS. 7A, 9 and 10 in addition to the aforementioned FIGS. 1-8, the additional seams near the corners insure that the sheet fits snugly and smoothly over the corners of the mattress, while the corner members 54, 56, 58, 60 and the border member 62 cooperate to hold the top panel 24 and side and end panels 28, 30, 32, 34 evenly and smoothly on the various corresponding surfaces of the mattress. Moreover, the fitted bed sheet 44 not only adjusts automatically to variations in the dimensions of a mattress, but can also be used for mattresses with varying heights, depending on the dimension chosen for the edges of the side and end panels 28, 30, 32, 34 (that is, the dimension chosen for the length of the lines 12 shown in FIG. 2). For example, if 16 inches is chosen for that dimension, then the fitted sheet will accommodate mattresses with heights ranging from 7 inches to 18 inches, whereas if 14 inches is chosen for that dimension, then the fitted sheet will accommodate mattresses with heights ranging from 5.5 inches to 16 inches, while if 18 inches is chosen for that dimension, then the fitted sheet will accommodate mattresses with heights ranging from 9 inches to 20 inches.

Figure 11:
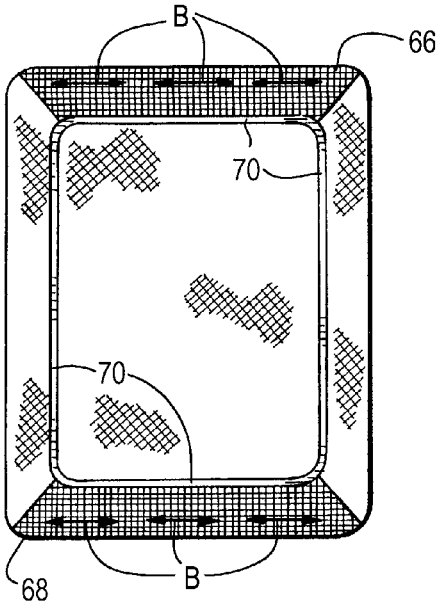
FIG. 11 PRIOR ART
FIGS. 11-13 are diagrammatic bottom plan views depicting several fitted bed sheets of the prior art.
Figure 12:
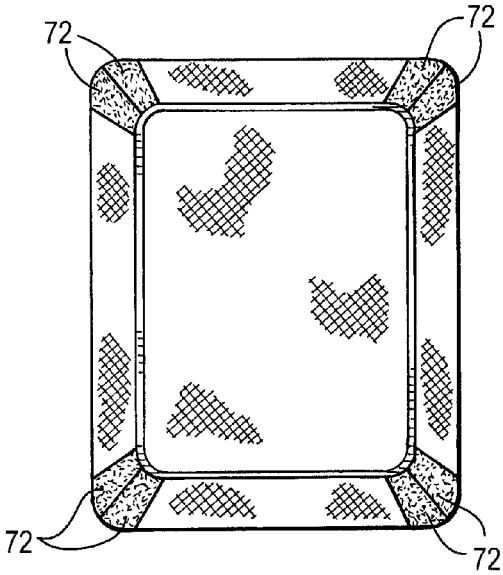
FIG. 12 PRIOR ART
Figure 13:
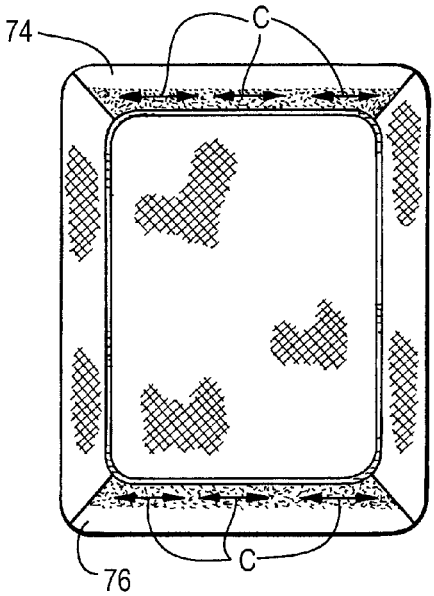
FIG. 13 PRIOR ART

Referring finally to FIGS. 11-13 in addition to the aforementioned FIGS. 1-10, further advantages of the fitted bed sheet 44 of the present invention over the fitted bed sheets of the prior art become apparent. The known fitted bed sheet in FIG. 11 (described in U.S. Pat. No. 5,287,574) is provided with the entirety of each end panel 66, 68 being made of a special stretchable (e.g., Lycra®) fabric, as indicated by the arrows B. This fitted sheet is expensive to make, and after a while the knitted fabric loses its flexibility (especially after repeated washing) and fails to maintain its stretching characteristics. In addition, although the outer peripheral edge 70 of this fitted sheet is provided with a circumferential tubular elasticized "cord," this material is of insufficient size to insure that the sheet remains in place during use. FIG. 12 shows another known fitted sheet (described in U.S. Pat. No. 8,171,581) that is provided with segments 72 of special stretchable (e.g., Lycra®) fabric positioned adjacent the corners. Again, this construction is expensive to manufacture, requiring special assembly, particularly near the corner seams, in order to join the stretchable fabric segments with the non-stretchable fabric making up the rest of the fitted sheet. FIG. 13 shows yet another known fitted sheet (described in U.S. Pat. No. 7,398,570), similar to the one in FIG. 11, except that the end panels 74, 76 are "composites" of dual construction, in which a stretchable portion (as indicated by the arrows C) is attached to a non-stretchable portion. Again, this structure is expensive and time-consuming to assemble.

While there has been described what are at present considered to be the preferred embodiments of the present invention, it will be apparent to those skilled in the art that the embodiments described herein are by way of illustration and not of limitation. Various modifications of the disclosed embodiments, as well as alternative embodiments of the invention, will become apparent to persons skilled in the art upon reference to the description of the invention. Therefore, it is to be understood that various changes and modifications may be made in the embodiments disclosed herein without departing from the true spirit and scope of the present invention, as set forth in the appended claims, and it is contemplated that the appended claims will cover any such modifications or embodiments.

The invention claimed is:

1. An article of bedding adapted for disposition over a mattress having a top surface, side surfaces, end surfaces and corners, the article comprising:

(a) a substantially inelastic web of textile material comprising a top panel having an outer periphery dimensioned to at least substantially cover the top surface of said mattress, two opposed side panels and two opposed end panels, each said side and end panel extending from the periphery of said top panel and dimensioned to at least substantially cover a respective side and end surface of said mattress, each said side and end panel having a pair of side edges and a distal peripheral edge spaced apart from said top panel, said distal peripheral edges together defining the perimeter of said article, the adjacent side edges of the side and end panels being connected to define four corner seams, each said corner seam adapted to at least substantially cover a corner of said mattress and each said corner seam having a longitudinal axis, a proximal end and a distal end;

(b) four stretchable corner members, each said corner member being associated with one of said corner seams and having an unstretched length which is shorter than the length of said associated corner seam, and each said corner member being secured in stretched condition to said article in a position substantially overlying said associated corner seam;

(c) four additional seams, each said additional seam being substantially aligned axially with the longitudinal axis of an associated corner seam, wherein each said additional seam extends substantially diagonally from the proximal end of said associated corner seam towards the center of said top panel; and (d) a stretchable border member having an unstretched length which is shorter than the length of the perimeter of said article, said border member being secured in stretched condition to the perimeter of said article.

2. The article of claim 1 wherein each said corner member is comprised of a strip of elastic material having a width ranging from about 8 mm to about 12 mm and having a length which is less than one-half of the length of said associated corner seam, and wherein said elastic material has a stretch ratio in the range of from about 1:2.75 to about 1:3.

3. The article of claim 2 wherein each said corner member is secured with lock stitching.

4. The article of claim 1 wherein said each said additional seam is about 1.5 inches long and is formed using Daug stitching.

5. The article of claim 1 wherein said border member is comprised of a strip of elastic material about 1 inch wide and having a length which is about one-half of the length of the perimeter of said article, and wherein said elastic material has a stretch ratio in the range of from about 1:1.75 to about 1:2.

6. The article of claim 5 wherein said border member is secured with twin needle lock stitching.

7. The article of claim 1 wherein the adjacent side edges of said side and end panels are connected with a five thread lock stitch to define said corner seams.

8. The article of claim 1 wherein said article is selected from the group consisting of bedsheets, bedspreads, blankets, quilts, duvets and duvet covers.

9. The article of claim 1 wherein said textile material is woven or knitted from threads selected from the group consisting of cotton yarns, silk yarns, wool yarns, rayon fibers, polyester fibers, viscose fibers and mixtures thereof.

10. The article of claim 1 wherein said mattress and said top panel are substantially rectangular in shape.

11. In a mattress covering fabricated of substantially inelastic textile material and having top, side and end panels for substantially covering the top surface, side surfaces and end surfaces, respectively, of a mattress, the side and end panels each having side edges, the adjacent side edges of the side and end panels being connected to form four corner seams, each said corner seam having a longitudinal axis, a proximal end and a distal end, the side and end panels also each having a distal peripheral edge spaced apart from said top panel, said distal peripheral edges together defining the perimeter of said mattress covering, the improvement comprising:

(a) four stretchable corner members, each said corner member being associated with one of said corner seams and having an unstretched length which is shorter than the length of said associated corner seam, each said corner member being secured in stretched condition to said mattress covering in a position substantially overlying said associated corner seam;

(b) four additional seams, each said additional seam being substantially aligned axially with the longitudinal axis of an associated corner seam, wherein each said additional seam extends substantially diagonally from the proximal end of said associated corner seam towards the center of said top panel; and (c) a stretchable border member having an unstretched length which is shorter than the length of the perimeter of said mattress covering, said border member being secured in stretched condition to the perimeter of said mattress covering.

12. The mattress covering of claim 11 wherein each said corner member is comprised of a strip of elastic material having a width ranging from about 8 mm to about 12 mm and having a length which is less than one-half of the length of said associated corner seam, and wherein said elastic material has a stretch ratio in the range of from about 1:2.75 to about 1:3.

13. The mattress covering of claim 12 wherein each said corner member is secured with lock stitching.

14. The mattress covering of claim 11 wherein said each said additional seam is about 1.5 inches long and is formed using Daug stitching.

15. The mattress covering of claim 11 wherein said border member is comprised of a strip of elastic material about 1 inch wide and having a length which is about one-half of the length of the perimeter of said mattress covering, and wherein said elastic material has a stretch ratio in the range of from about 1:1.75 to about 1:2.

16. The mattress covering of claim 15 wherein said border member is secured with twin needle lock stitching.

17. The mattress covering of claim 11 wherein the adjacent side edges of said side and end panels are connected with a five thread lock stitch to define said corner seams.

18. The mattress covering of claim 11 wherein said mattress covering is selected from the group consisting of bedsheets, bedspreads, blankets, quilts, duvets and duvet covers.

19. The mattress covering of claim 11 wherein said textile material is woven or knitted from threads selected from the group consisting of cotton yarns, silk yarns, wool yarns, rayon fibers, polyester fibers, viscose fibers and mixtures thereof.

20. The mattress covering of claim 11 wherein said mattress and said top panel are substantially rectangular in shape.

21. A bedding product comprising (a) a substantially inelastic web of textile material comprising a top panel, two opposed side panels and two opposed end panels, each said side and end panel extending from the periphery of said top panel, each said side and end panel having a pair of side edges and a distal peripheral edge spaced apart from said top panel, said distal peripheral edges together defining the perimeter of said product, the adjacent side edges of the side and end panels being connected to define four corner seams, and each said corner seam having a longitudinal axis, a proximal end and a distal end;

(b) four stretchable corner members, each said corner member being associated with one of said corner seams and having an unstretched length which is shorter than the length of said associated corner seam, each said corner member being secured in stretched condition to said bedding product in a position substantially overlying said associated corner seam;

(c) four additional seams, each said additional seam being substantially aligned axially with the longitudinal axis of an associated corner seam, wherein each said additional seam extends substantially diagonally from the proximal end of said associated corner seam towards the center of said top panel; and (d) a stretchable border member having an unstretched length which is shorter than the length of the perimeter of said bedding product, said border member being secured in stretched condition to the perimeter of said bedding product.

22. The bedding product of claim 21 wherein each said corner member is comprised of a strip of elastic material having a width ranging from about 8 mm to about 12 mm and having a length which is less than one-half of the length of said associated corner seam, and wherein said elastic material has a stretch ratio in the range of from about 1:2.75 to about 1:3.

23. The bedding product of claim 22 wherein each said corner member is secured with lock stitching.

24. The bedding product of claim 21 wherein said each said additional seam is about 1.5 inches long and is formed using Daug stitching.

25. The bedding product of claim 21 wherein said border member is comprised of a strip of elastic material about 1 inch wide and having a length which is about one-half of the length of the perimeter of said bedding product, and wherein said elastic material has a stretch ratio in the range of from about 1:1.75 to about 1:2.

26. The bedding product of claim 25 wherein said border member is secured with twin needle lock stitching.

27. The bedding product of claim 21 wherein the adjacent side edges of said side and end panels are connected with a five thread lock stitch to define said corner seams.

28. The bedding product of claim 21 wherein said bedding product is selected from the group consisting of bedsheets, bedspreads, blankets, quilts, duvets and duvet covers.

29. The bedding product of claim 21 wherein said textile material is woven or knitted from threads selected from the group consisting of cotton yarns, silk yarns, wool yarns, rayon fibers, polyester fibers, viscose fibers and mixtures thereof.

30. The bedding product of claim 21 wherein said mattress and said top panel are substantially rectangular in shape.

31. A method of making an improved article of bedding, for disposition over a mattress, from a substantially inelastic substantially rectangular web of textile material having four sides and four corners, the method comprising the steps of:

(a) cutting out and removing from the web a substantially square portion at each of the four corners, each said square portion being defined by two lines of cut of substantially equal length, each said line being substantially straight and generally perpendicular to a different side of the web, the length of each said line being dimensioned such that following said removing, the remaining portion of the web defines a top panel and side and end panels for substantially covering the top surface, side surfaces and end surfaces, respectively, of said mattress;

(b) connecting the adjacent edges of said side and end panels to form four corner seams, each said corner seam having a longitudinal axis, a proximal end and a distal end;

(c) providing four stretchable corner members, each said corner member being associated with one of said corner seams and having an unstretched length which is shorter than the length of said associated corner seam, and securing each said corner member in stretched condition to said article in a position substantially overlying said associated corner seam;

(d) forming four additional seams in said article, each said additional seam being substantially aligned axially with the longitudinal axis of an associated corner seam and each said additional seam extending substantially diagonally from the proximal end of said associated corner seam towards the center of said top panel; and (e) providing a stretchable border member having an unstretched length which is shorter than the length of the perimeter of said article, and securing said border member in stretched condition to the perimeter of said article.

32. The method of claim 31 wherein each said corner member is comprised of a strip of elastic material having a width ranging from about 8 mm to about 12 mm and having a length which is less than one-half of the length of said associated corner seam, and wherein said elastic material has a stretch ratio in the range of from about 1:2.75 to about 1:3.

33. The method of claim 32 wherein each said corner member is secured with lock stitching.

34. The method of claim 31 wherein said each said additional seam is about 1.5 inches long and is formed using Daug stitching.

35. The method of claim 31 wherein said border member is comprised of a strip of elastic material about 1 inch wide and having a length which is about one-half of the length of the perimeter of said article, and wherein said elastic material has a stretch ratio in the range of from about 1:1.75 to about 1:2.

36. The method of claim 35 wherein said border member is secured with twin needle lock stitching.

37. The method of claim 31 wherein the adjacent side edges of said side and end panels are connected with a five thread lock stitch to define said corner seams.

38. The method of claim 31 wherein said article is selected from the group consisting of bedsheets, bedspreads, blankets, quilts, duvets and duvet covers.

39. The method of claim 31 wherein said textile material is woven or knitted from threads selected from the group consisting of cotton yarns, silk yarns, wool yarns, rayon fibers, polyester fibers, viscose fibers and mixtures thereof.

40. A method of making an article of bedding comprising a mattress covering fabricated of substantially inelastic textile material and having a top panel for fitting in overlaying relationship to a top surface of a mattress and peripheral side and end panels for overlaying the sides and ends of the mattress, the side and end panels each having side edges and a distal peripheral edge spaced apart from said top panel, said distal peripheral edges together defining the perimeter of said article, the method comprising the steps of:

(a) connecting the adjacent edges of said side and end panels to form four corner seams, each said corner seam having a longitudinal axis and a proximal end and a distal end;

(b) providing four stretchable corner members, each said corner member being associated with one of said corner seams and having an unstretched length which is shorter than the length of said associated corner seam, and securing each said corner member in stretched condition to said article in a position substantially overlying said associated corner seam;

(c) forming four additional seams in said article, each said additional seam being substantially aligned axially with the longitudinal axis of an associated corner seam and each said additional seam extending substantially diagonally from the proximal end of said associated corner seam towards the center of said top panel; and (d) providing a stretchable border member having an unstretched length which is shorter than the length of the perimeter of said article, and securing said border member in stretched condition to the perimeter of said article.

41. The method of claim 40 wherein each said corner member is comprised of a strip of elastic material having a width ranging from about 8 mm to about 12 mm and having a length which is less than one-half of the length of said associated corner seam, and wherein said elastic material has a stretch ratio in the range of from about 1:2.75 to about 1:3.

42. The method of claim 41 wherein each said corner member is secured with lock stitching.

43. The method of claim 40 wherein said each said additional seam is about 1.5 inches long and is formed using Daug stitching.

44. The method of claim 40 wherein said border member is comprised of a strip of elastic material about 1 inch wide and having a length which is about one-half of the length of the perimeter of said article, and wherein said elastic material has a stretch ratio in the range of from about 1:1.75 to about 1:2.

45. The method of claim 44 wherein said border member is secured with twin needle lock stitching.

46. The method of claim 40 wherein the adjacent side edges of said side and end panels are connected with a five thread lock stitch to define said corner seams.

47. The method of claim 40 wherein said article is selected from the group consisting of bedsheets, bedspreads, blankets, quilts, duvets and duvet covers.

48. The method of claim 40 wherein said textile material is woven or knitted from threads selected from the group consisting of cotton yarns, silk yarns, wool yarns, rayon fibers, polyester fibers, viscose fibers and mixtures thereof.

49. The method of claim 40 wherein said mattress and said top panel are substantially rectangular in shape.

* * * * *